United States Patent [19]

Kawamura

[11] 4,273,683

[45] Jun. 16, 1981

[54] OXIDE CATHODE AND PROCESS FOR PRODUCTION THEREOF

[75] Inventor: Takao Kawamura, Chiba, Japan

[73] Assignee: Hitachi, Ltd., Tokyo, Japan

[21] Appl. No.: 969,179

[22] Filed: Dec. 13, 1978

[30] Foreign Application Priority Data

Dec. 16, 1977 [JP] Japan ..... 52-150545
Dec. 16, 1977 [JP] Japan ..... 52-150546

[51] Int. Cl.[3] ..... H01B 1/02

[52] U.S. Cl. ..... 252/513; 252/515; 252/518; 252/521; 313/346 R; 313/346 DC; 29/25.14; 427/77; 427/78; 427/226; 428/552

[58] Field of Search ..... 252/513, 515, 518, 521; 313/346 R, 346 DC; 427/77, 78, 81, 226; 29/25.14, 25.17; 428/552

[56] References Cited

U.S. PATENT DOCUMENTS

| | | | |
|---|---|---|---|
| 2,716,716 | 8/1955 | Hughes et al. | 313/346 |
| 2,848,644 | 8/1958 | Koppius | 313/346 |
| 3,170,772 | 2/1965 | Sato et al. | 313/346 DC X |
| 3,719,856 | 3/1973 | Koppius | 313/346 DC |
| 3,842,309 | 10/1974 | van Stratum et al. | 313/346 DC |
| 3,879,830 | 4/1975 | Buescher | 252/513 X |
| 4,083,811 | 4/1978 | Bachmann et al. | 252/509 |
| 4,101,800 | 7/1978 | Thomas et al. | 313/346 DC |
| 4,147,954 | 4/1979 | Tuck | 313/346 DC |

*Primary Examiner*—Benjamin R. Padgett
*Assistant Examiner*—J. L. Barr
*Attorney, Agent, or Firm*—Craig and Antonelli

[57] ABSTRACT

An oxide cathode wherein a base is made of an alloy comprising Ni as a main component and at least one reducing element selected from the group consisting of Mg, W, Zr, Si, Al and C, and the surface of the base is coated with an alkaline earth oxide layer containing at least BaO, the BaO content in the inner portion of the oxide layer contacting with the base being lower than that in the superficial portion of the oxide layer, if desired, forming a roughened layer made of powdered Ni or the like between the base and the inner portion of the oxide layer, can inhibit the formation of interface layer of, e.g. $Ba_3WO_6$ and maintain stable thermion emitting characteristics for a long period of time.

13 Claims, 6 Drawing Figures

OXIDE CATHODE AND PROCESS FOR PRODUCTION THEREOF

BACKGROUND OF THE INVENTION

This invention relates to an oxide cathode emitting thermions. In particular, it relates to an oxide cathode in which the formation of interface layer is inhibited and troubles such as peeling of an oxide layer from the surface of base metal plate are prevented, as well as to a process for producing said oxide cathode.

Since an oxide cathode can emit thermions with a high efficiency at a relatively low temperature, it is widely employed in general uses, such as an image receiving tube in television. It is important for the oxide cathode to keep the emission of electron stable for a long period of time.

A conventional oxide cathode is constructed in that a layer of electron emissive alkaline earth metal oxide such as BaO alone, or a mixture of BaO, SrO and CaO in the form of composite substance (solid solution), is formed on a base made of an alloy comprising Ni as a main component and one or more reducing elements such as Mg, W, Si, Al, Zr and the like. When heated at a temperature of about 800° C., it emits thermions. It is considered that the reducing element present in the base metal continuously reduces BaO, and the Ba thereby liberated functions as a center of the emission of thermions. Accordingly, if this reaction begins to lose its stability, electron-emitting characteristics of the cathode deteriorate. A cause of the deterioration seems to be at least partly attributable to the formation of a so-called interface layer of, for example, $Ba_3WO_6$ between the base and the alkaline earth metal oxide layer.

The occurrence of the interface layer is particularly marked when W or Mo is incorporated into the base metal in order to enhance strength of a cathode at high temperatures and thereby to prevent its deformation, or in order to enhance its specific electric resistance and thereby to make it suitable for a directly heated type cathode. Also, it is frequently experienced that the formation and disappearance of the interface layer of, e.g., $Ba_3WO_6$, induce peeling of the alkaline earth metal oxides from the base which ultimately results in destruction of cathode itself. One of the techniques for preventing this peeling is to roughen the surface of base by fusing powdered Ni or metal powder having the same composition as the base on the surface of base to be contacted with the oxide layer. However, the formation and disappearance of interface layer is so powerful as to destroy even the roughened surface and to make the roughened surface effectless. In conclusion, it is the most effective means for obtaining stable electron emitting characteristics to suppress the formation of interface layer to the utmost.

SUMMARY OF THE INVENTION

It is an object of this invention to provide an oxide cathode in which the formation of interface layer is inhibited and stable electron emitting characteristics are retained for a long period of time, as well as to provide a process for producing said oxide cathode.

This invention provides an oxide cathode wherein an oxide layer comprising oxides of alkaline earth metals including at least Ba is formed on the surface of a base made of an alloy comprising Ni as a main component and at least one reducing element selected from the group consisting of Mg, W, Zr, Si, Al and C, said oxide cathode being imposed in that a BaO content in the inner portion of the oxide layer contacting with the base is made lower than that in the superficial portion of the oxide layer. This invention also provides a process for producing said improved oxide cathode.

Further, this invention provides an oxide cathode having a roughened layer strongly adhered to the surface of the base, said roughened layer being formed by the use of powdered Ni or metal powder containing Ni as a main component and at least one reducing element selected from the group consisting of Mg, Si, Al, C, W and Zr, between the base and the inner portion of the oxide layer of alkaline earth metal oxides. This invention also provides a process for producing an oxide cathode having the roughened layer.

BRIEF DESCRIPTION OF THE DRAWINGS

FIG. 2, FIG. 4 and FIG. 6 illustrate the cases in which a roughened layer is formed on the surface of base by the use of powdered Ni or metal powder containing Ni as a main component and at least one reducing element mentioned above.

DETAILED DESCRIPTION OF THE PREFERRED EMBODIMENT

Figure 3:
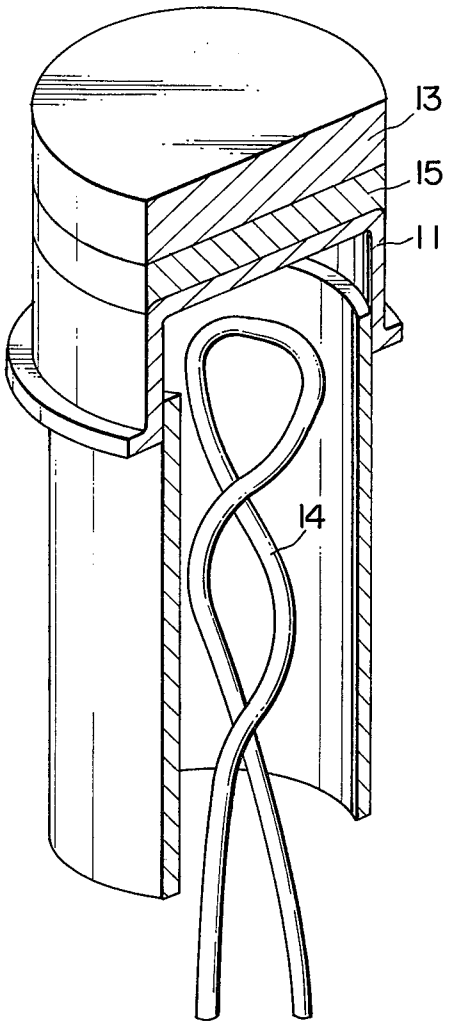
FIG. 3 and FIG. 4 are perspective sectional views each illustrating one example of indirectly heated oxide cathodes according to this invention.

In this invention, the fact that Ba is the most remarkable causal substance for the formation of interface layer and simultaneously acts as a center for the emission of thermions is taken into consideration, and the above-mentioned object of the invention is achieved by forming an oxide layer comprising a mixture of BaO and plural kinds of other alkaline earth metal oxides so that a BaO content in the inner portion of the oxide layer directly contacting with the surface of the base is lower than the BaO content in the outer superficial portion of the oxide layer which directly participates in the emission of thermions. Since alkaline earth metals and oxides thereof mutually form solid solutions, there is found no trouble in grading BaO content in the direction of the thickness of the oxide layer.

The base metals usable in the oxide cathode of this invention which may be usually employed are ones which comprise Ni as a main component and at least one reducing element selected from the group consisting of Mg, W, Zr, Si, Al and C.

An embodiment of this invention will be illustrated in more detail by referring to the drawings attached.

Figure 2:
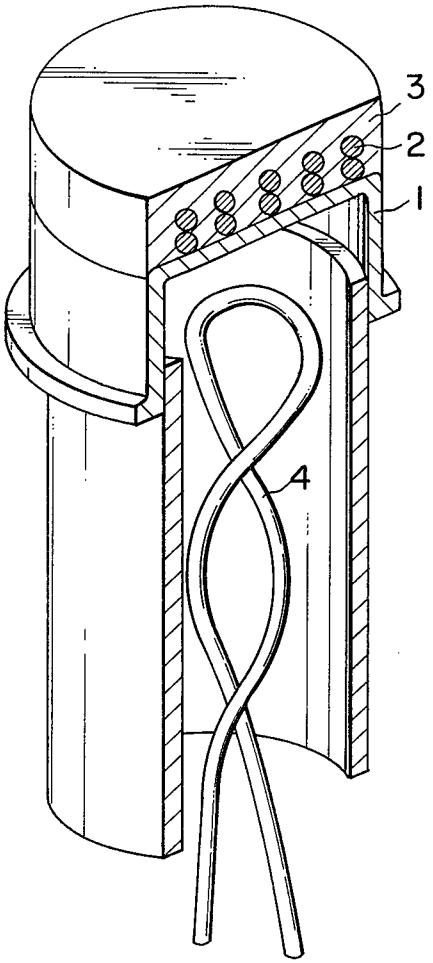
FIG. 1 and FIG. 2 are perspective sectional views each illustrating one example of conventional indirectly heated oxide cathodes.
Figure 1:
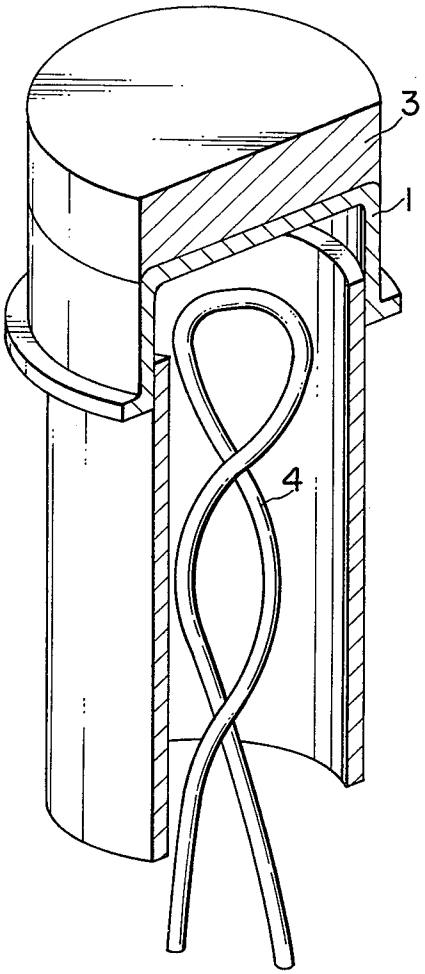

FIG. 1 and FIG. 2 are perspective sectional views each illustrating one example of conventional indirectly heated oxide cathodes, wherein a cup-like base 1 made of an alloy comprising: for example, Ni as its main component, 0.5% by weight of Mg as a reducing element, and 4% by weight of W for the purpose of enhancing reducing power and strength at high temperatures.

In FIG. 2, a base 1 is coated with powdered Ni or metal powder having the same composition as the base metal by e.g., a spraying method or the like, and subsequently heated in an atmosphere of hydrogen or in vacuum at a fusing temperature of powdered Ni or the like, for example at 1000° C., so as to make the Ni powder or the like fuse and strongly adhere to the base and consequently to make the surface of the base 1 rough by the protruding Ni powder or the like 2.

Then, the roughened base is coated with the oxide layer 3 of $BaCO_3$ alone or a mixture of alkaline earth metal carbonates comprising $BaCO_3$, $SrCO_3$ and $CaCO_3$. From the experience, a cathode having the best electron-emitting characteristics can be obtained by using a composite salt (Ba, Sr, Ca)$CO_3$ containing 47% by mole of $BaCO_3$, 43% by mole of $SrCO_3$ and 10% by mole of $CaCO_3$. When this cathode is heated in vacuum by means of a heater 4 at a temperature of, for example, 1000° C., the composite salt is decomposed to yield a solid solution of BaO, SrO and CaO. This reaction can be expressed as follows:

$$(Ba, Sr, Ca)CO_3 \rightarrow (Ba, Sr, Ca)O + CO_2$$

During the decomposition, however, the salts can also take part in a reaction with a reducing element present in the base metal which results in the formation of an interface layer. Particularly, when the base metal contains a large quantity of W (content of W can sometimes be as high as about 30% by weight in directly heated cathodes) or when it contains Zr, this reaction takes place outstandingly, which can be expressed, for example, as follows:

$$3BaCO_3 + W \rightarrow Ba_3WO_6 + 3CO$$

$$BaCO_3 + Zr \rightarrow BaZrO_3 + C$$

However, X-ray diffraction analysis reveals that these interface layer products are not single substances but complicated mixtures of substances different in compositions. These interface layers are predominantly formed at the portion where the carbonate layer 3 is directly contacted with the base 1.

As revealed by X-ray analysis, these interface layer substances change their quantities and properties depending on the period during which the cathode has been used, which means that the interface layers are not only formed when carbonate layer 3 is thermally decomposed to form a solid solution of the alkaline earth metal oxides but also formed or extinguished in the course of using the cathode. Since the interface layer substances are formed through oxidation and reduction of the metals, they are affected by shapes of the base 1 and the Ni powder or the like 2 and, in some extreme cases, the roughened surface produced on the base is completely destroyed or the roughened surface itself is extinguished.

FIG. 3 is a perspective sectional view illustrating one example of indirectly heated cathodes according to this invention, wherein the cup-like base 11 is made of an alloy comprising: for example, Ni as a main component and about 0.01–40% by weight of one or more Mg, Zr, W and the like as reducing element or in order to enhance strength at high temperatures, numeral 14 denotes a heater, numeral 15 denotes the inner portion of the oxide layer and numeral 13 denotes the superficial portion of the oxide layer.

Figure 4:
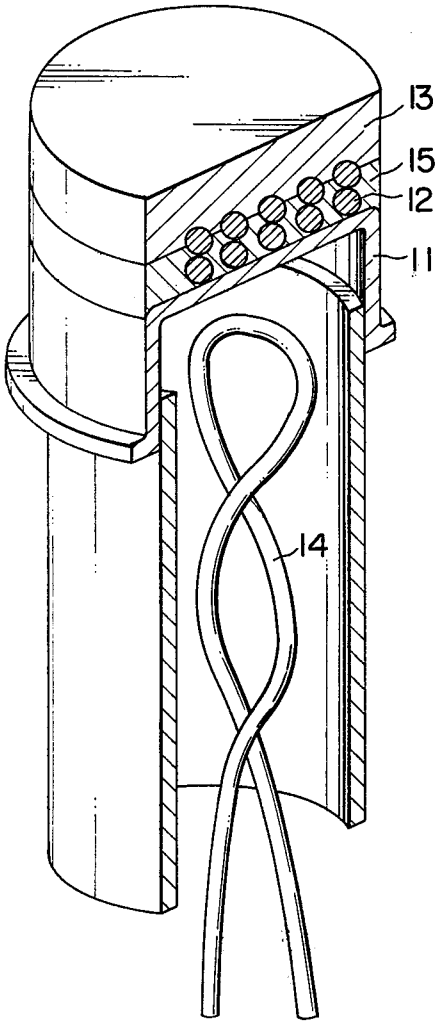

FIG. 4 is a perspective sectional view illustrating one example of indirectly heated type cathodes having a roughened surface of powdered Ni or metal powder containing Ni as a main component and at least one reducing element selected from the group consisting of Mg, Si, Al, C, W and Zr, on the surface of the base. The base 11 is the same one as in FIG. 3. The roughened surface is prepared by coating the base 11 with Ni powder or the like 12 by, for example, a spraying or printing method and heating it in an atmosphere of hydrogen or in vacuum at a fusing temperature of powdered Ni or the like (for example, at 1000° C.) to fuse the powdered Ni or the like 12 on the surface of the base 11. These procedures are the same as those in the conventional cathode shown in FIG. 2.

Figure 5:
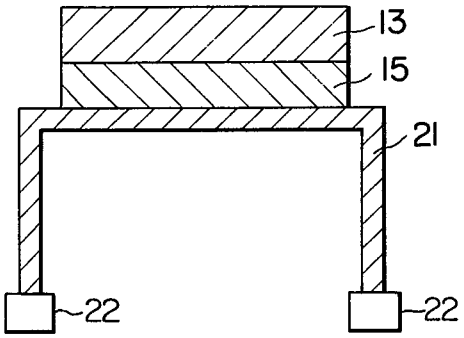
FIG. 5 and FIG. 6 are sectional views each illustrating one example of directly heated oxide cathodes according to this invention.
Figure 6:
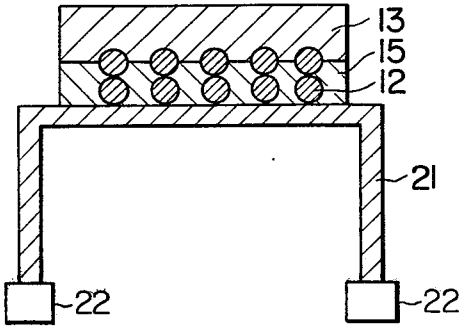

FIG. 5 and FIG. 6 are sectional views illustrating each one example of the directly heated type oxide cathode according to this invention, wherein a sheet-like base 21 is made of an alloy comprising, for example, Ni as a main component, 10–30% by weight of W in order to obtain the desired electric resistance and strength at high temperatures, and about 0.01–5% by weight of at least one reducing element such as Zr in order to activate electron-emission, and numeral 22 denotes terminals for supplying the electric current from a power source not shown in the drawing, numerals 12, 13 and 15 have the same meanings as described in FIGS. 3 and 4. By flowing the predetermined amount of current through the base, the base can reach the appointed temperature where it can operate.

When an oxide cathode was prepared by spraying one of single salt selected from the group of $BaCO_3$, $SrCO_3$ and $CaCO_3$ over the base 11 (or 21) and then pyrolyzing it in vacuum, each oxide cathode thus obtained was overwhelmingly inferior to those prepared by using the composite salts of $BaCO_3$, $SrCO_3$ and $CaCO_3$ in thermion emitting characteristics, and was unsuitable for practical use. However, the formation of interface layers was the greatest in the case of $BaCO_3$ and decreased in the order of $BaCO_3$, $SrCO_3$ and $CaCO_3$, and particularly a single $CaCO_3$ salt gave an overwhelmingly smaller quantity of interface layers than any of the other single salts.

Next, each oxide cathode was prepared by spraying one of the single salts mentioned above over a base, followed by spraying a composite salt of (Ba, Sr, Ca)$CO_3$ comprising 47% by mole of $BaCO_3$, 43% by mole of $SrCO_3$ and 10% by mole of $CaCO_3$ and finally pyrolyzing them in vacuum. The oxide cathodes thus obtained showed the same order as mentioned above as to the amount of interface layer formation; but as to the thermion emitting characteristics, the one undercoated with the $BaCO_3$ single salt showed the best performance, the one undercoated with the $SrCO_3$ the next, and the one undercoated with the $CaCO_3$ the worst.

In other words, from the standpoint of decreasing the amount of formation of interface layer, as the carbonate layer 15 to be contacted with the base 11 (or 21), the most desirable one is constituted of a larger proportion of $CaCO_3$, which is followed by $SrCO_3$ and then by $BaCO_3$, in this order; whereas from the standpoint of improving thermion emitting characteristics, the one constituted of a larger proportion of $BaCO_3$ is the most desirable, which is followed by $SrCO_3$ and then by $CaCO_3$.

Based on the experimental results mentioned above, the inventors prepared cathodes as shown in FIGS. 3, 4, 5 and 6 by spraying a composite salt of (Sr, Ca)$CO_3$ comprising 50% by mole of $SrCO_3$ and 50% by mole of $CaCO_3$ as a carbonate layer 15 to be contacted with the base 11 (or 21), spraying thereon a superficial carbonate layer 13 of composite salt of (Ba, Sr, Ca)$CO_3$ comprising 47% by mole of $BaCO_3$, 43% by mole of $SrCO_3$ and 10% by mole of $CaCO_3$ to make a composite layer in order to obtain good thermion emitting characteristics, and then thermally decomposing them in vacuum at a temperature of about 1000° C. to form a solid function of alkaline earth metal oxides. Properties of the thus prepared cathodes were investigated with the results in that the formation of interface layers was by far very small in amounts and thermion emitting characteristics were also excellent.

Apart from above, the inventors also examined various cathodes in which the ratio of $SrCO_3$ to $CaCO_3$ is changed from 100% by mole to 0% by mole, as well as cathodes prepared by adding $BaCO_3$ to them. All these cathodes showed the same tendency as mentioned above.

Accordingly, in the production of oxide cathodes, it is desirable to make a content of $BaCO_3$ in the portion of the carbonate layer which contacts with the base lower or nil and to make a content of $BaCO_3$ in the outer superficial portion of the carbonate layer participating in the emission of thermions to an appropriate value within the range of 40–80% by mole, for example the above-mentioned 47% by mole. It is also possible to apply a carbonate layer which has no clear border line between layers therein unlike the composite layer mentioned above but has gradually changing compositions therein.

As mentioned above, in the oxide cathode of this invention, the BaO content in alkaline earth metal oxide layer is suppressed preferably to a value of 0–40% by mole in the inner portion of the oxide layer to be contacted with the base, while the BaO content in the outer superficial portion of the oxide layer is made higher than that of the inner portion of the oxide layer, preferably 40–80% by mole, the difference between the two being preferably 20–80% by mole.

According to this invention, there can be produced oxide cathodes which have excellent, stable thermion emitting characteristics over a long period of time with nearly the same producing cost as in the case of conventional cathodes. The effects of the present invention mentioned above are particularly great in cathodes in which the base metal used contains a large quantity of W or in cathodes in which the base metal used contains a large quantity of W and the surface of the base is roughened by fusing powdered metal thereon in order to prevent the peeling of the alkaline earth metal oxide layer.

I claim:

1. In an oxide cathode wherein an oxide layer comprising oxides of alkaline earth metals including Ba is formed on the surface of a base made of an alloy comprising Ni as a main component and at least one reducing element selected from the group consisting of Mg, W, Zr, Si, C and Al, the improvement which comprises 0–40% by mole BaO content in the inner portion of the oxide layer contacting with the base and 40–80% by mole BaO content in the superficial portion of the oxide layer, wherein the content of BaO in said inner portion being 20–80% by mole less than the content of BaO in said superficial portion.

2. An oxide cathode according to claim 1, wherein a roughened layer made of powdered Ni or metal powder containing Ni as a main component and at least one reducing element selected from the group consisting of Mg, Si, Al, C, W and Zr is formed between the base and the inner portion of the oxide layer.

3. An oxide cathode according to claim 1 or 2, wherein the BaO content in the inner portion of the oxide layer contacting with the base is zero.

4. In a process for producing an oxide cathode comprising coating one or more carbonates of alkaline earth metals including Ba on the surface of a base made of an alloy comprising Ni as a main component and at least one reducing element selected from the group consisting of Mg, W, Zr, Si, C and Al, and forming an oxide layer of the alkaline earth metals by pyrolysis of the alkaline earth carbonates, the improvement which comprises coating 0–40% by mole of $BaCO_3$ content in the inner portion of the carbonate layer contacting with the base and 20–80% by mole of $BaCO_3$ content in the superficial portion of the carbonate layer, wherein the content of $BaCO_3$ in the inner portion is 20–80% by mole less than the content of $BaCO_3$ in the superficial portion.

5. A process for producing an oxide cathode according to claim 4, wherein a roughened layer made of powdered Ni or metal powder containing Ni as a main component and at least one reducing element selected from the group consisting of Mg, Si, Al, C, W and Zr is formed between the base and the inner portion of the carbonate layer.

6. A process for producing an oxide cathode according to claim 4 or 5, wherein a $BaCO_3$ content in the inner portion of the carbonate layer contacting with the base is zero.

7. A process for producing an oxide cathode according to claim 4 or 5, wherein a plurality of carbonate layers having gradually increasing amounts of $BaCO_3$ are coated on the base one after one, the $BaCO_3$ content in the inner portion of the carbonate layer contacting with the base being zero.

8. An oxide cathode comprising a base of a Ni alloy having at least one reducing element selected from the group consisting of Mg, W, Zr, Si, C and Al and an oxide coating on the base comprising an inner oxide layer and an outer oxide layer, the inner oxide layer having a BaO content that is 20–80% by mole less than the content of BaO in the outer layer.

9. An oxide cathode according to claim 8, wherein the BaO content in the inner oxide layer adjacent to the base is zero.

10. A process for producing an oxide cathode comprising coating a base of a Ni alloy having at least one reducing element selected from the group consisting of Mg, W, Zr, Si, C and Al, with at least two alkaline earth metal carbonate layers having different $BaCO_3$ contents, the layer with the lowest $BaCO_3$ content being applied on the base first and then being covered with a layer of a higher $BaCO_3$ content, the layer with the lowest $BaCO_3$ content having 20–80% by mole less $BaCO_3$ content than the layer with higher $BaCO_3$ content, and pyrolyzing the alkaline earth metal carbonate layers to form oxide layers.

11. A process for producing an oxide cathode according to claim 10, wherein the first alkaline earth metal carbonate layer coated on the base is a composite salt comprising 50% by mole $SrCO_3$ and 50% by mole $CaCO_3$.

12. A process for producing an oxide cathode according to claim 11, wherein the last alkaline earth metal carbonate layer coated on the base is a composite salt comprising 47% by mole $BaCO_3$, 43% by mole $SrCO_3$ and 10% by mole $CaCO_3$.

13. A process for producing an oxide cathode according to claim 11, wherein the $BaCO_3$ content in the first layer is 20 to 80% by mole less than the $BaCO_3$ content in the last layer.

* * * * *